US007331658B2

(12) United States Patent
Hengesbach et al.

(10) Patent No.: US 7,331,658 B2
(45) Date of Patent: Feb. 19, 2008

(54) ANTI-WICKING CATCHER ASSEMBLY AND PRINTING SYSTEM

(75) Inventors: Paul K. Hengesbach, Kettering, OH (US); David F. Tunmore, Xenia, OH (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/424,970

(22) Filed: Jun. 19, 2006

(65) Prior Publication Data

US 2007/0291085 A1 Dec. 20, 2007

(51) Int. Cl.
*B41J 0/09* (2006.01)

(52) U.S. Cl. ..... 347/77

(58) Field of Classification Search ..... 347/90, 347/82, 78, 77, 73, 35, 34, 30–32
See application file for complete search history.

(56) References Cited

U.S. PATENT DOCUMENTS 4,928,115 A 5/1990 Fagerquist et al.
5,475,410 A 12/1995 Durst et al.
6,688,733 B1 2/2004 Huliba
6,688,736 B1 2/2004 Tunmore et al.
6,736,498 B2 * 5/2004 Blum ..... 347/90
6,793,327 B2 9/2004 Huliba
6,962,411 B2 11/2005 West et al.

* cited by examiner

*Primary Examiner*—K. Feggins
(74) *Attorney, Agent, or Firm*—William R. Zimmerli

(57) ABSTRACT

A printing system includes a catcher having a length with portions of the catcher defining a fluid drop contact region and an opening for passage of the fluid away from the fluid contact region with the opening having two ends. A fluid drop generator is operable to form fluid drops at least some of which contact the fluid drop contact region of the catcher. An eyelid is operatively associated with the catcher. A pair of walls are positionable at locations outside of the ends of the opening such that the pair of walls and the eyelid are operable to form a fluid seal at least partially around the opening of the catcher. A first portion of the each of the pair of walls extends in a first direction toward the fluid drop generator, and a second portion of each of the pair of walls extends in a second direction at least partially toward each other.

13 Claims, 5 Drawing Sheets

ANTI-WICKING CATCHER ASSEMBLY AND PRINTING SYSTEM

FIELD OF THE INVENTION

This invention relates generally to the field of digitally controlled printing devices, and in particular to continuous ink jet printers in which a liquid stream breaks into drops, some of which are selectively deflected.

BACKGROUND OF THE INVENTION

Problems associated with liquid wicking out of a catcher are known. For example, U.S. Pat. No. 6,962,411, issued to West et al. on Nov. 8, 2005, discloses a catcher including vacuum channels positioned on both sides of a liquid removal opening, commonly referred to as a throat, of the catcher. The vacuum channels remove accumulated liquid, for example, ink, from a face of the catcher and from a liquid sealing mechanism, commonly referred to as an eyelid. Additionally, a scoop can be located in a catch pan of the catcher to remove liquid accumulated below the catcher face.

A pair of walls can also be positioned on either side of a liquid removal opening of a catcher to reduce liquid wicking out of the catcher. Referring to FIGS. 1 and 2, a drop generator (not shown) of a printhead assembly 34 is operable to create liquid drops 2 in a known manner. Some of the liquid drops 2 are deflected in a known manner toward a contact region 30 of a catcher face 4 of the catcher 32. After the liquid drops 2 impinge the contact region 30 of the catcher face 4, the liquid drops 2 form a liquid film 3 that travels toward a liquid removal opening or throat 5 from which the liquid is removed from the printhead assembly 34 and either recycled or disposed.

An eyelid (not shown) is operatively associated with the catcher to form an eyelid seal 1 with the catcher 32 in order to prevent liquid from contacting a recording media during a start up (and a shut down) sequence. After the start up sequence is complete, the eyelid is positioned away from the catcher 32 to enable liquid drops to pass between the eyelid and the catcher and contact the recording media.

The eyelid includes a pair of walls 36 (only one of which is shown in FIGS. 1 and 2) positioned on either side of the liquid removal opening 5 of the catcher 32 that contact the catcher 32. The eyelid also includes a lip 38 that contacts the catcher 32 below a catch pan 6 of the catcher 32.

While this solution helps to prevent liquid from leaking from the sides of the catcher and contacting either the recording media or the printer hardware, it does not prevent the liquid from wicking up the face of the catcher toward printer hardware, for example, a charge electrode 7 and its associated circuitry, located above the catcher, as shown in FIGS. 1 and 2.

In FIG. 1, air flow 8 present in the printhead assembly 34 can cause accumulated liquid 9 to wick directly up the catcher face 4 adjacent to each wall 36 where the liquid 9 can make contact with the charge electrode and its associated circuitry. In FIG. 2, accumulated liquid 9 wicks up the catcher face 4 adjacent to each wall 36 but does not directly contact the charge electrode 7 and its associated circuitry. Instead, the liquid 9 wicks inward toward the charge electrode 7 and its associated circuitry after wicking up the catcher face 4 because the pair of walls 36 is positioned closer to liquid removal opening 5 in FIG. 1 as compared to the wall 36 position shown in FIG. 2. In either case, a printhead assembly 34 operational failure can occur.

As such, there is a need to reduce or even prevent liquid from wicking up the catcher face.

SUMMARY OF THE INVENTION

According to an aspect of the invention, a printing system includes a catcher having a length with portions of the catcher defining a fluid drop contact region and an opening for passage of the fluid away from the fluid contact region with the opening having two ends. A fluid drop generator is operable to form fluid drops at least some of which contact the fluid drop contact region of the catcher. An eyelid is operatively associated with the catcher. A pair of walls are positionable at locations outside of the ends of the opening such that the pair of walls and the eyelid are operable to form a fluid seal at least partially around the opening of the catcher. A first portion of the each of the pair of walls extends in a first direction toward the fluid drop generator, and a second portion of each of the pair of walls extends in a second direction at least partially toward each other.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
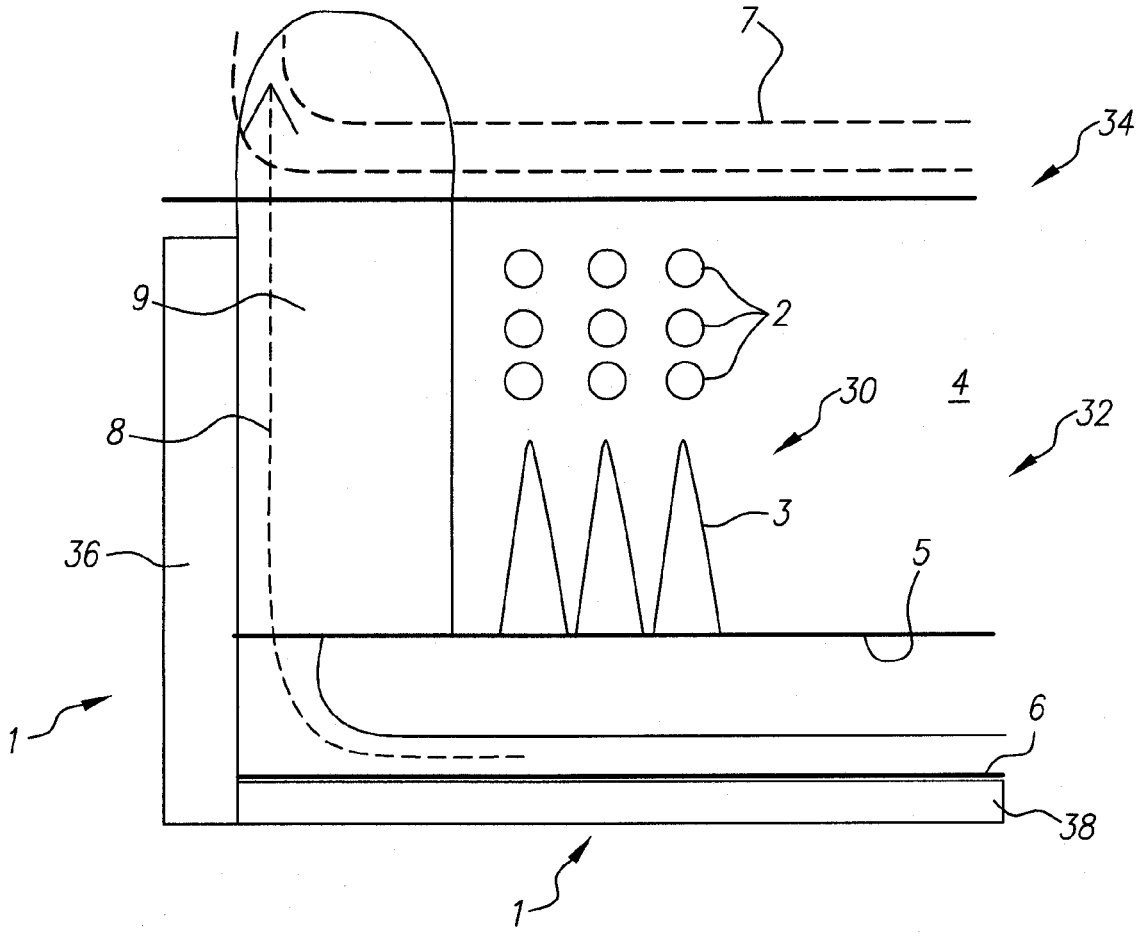
FIG. 1 (Prior Art)
FIG. 1 is a partial schematic view of a prior art printhead assembly.
Figure 2:
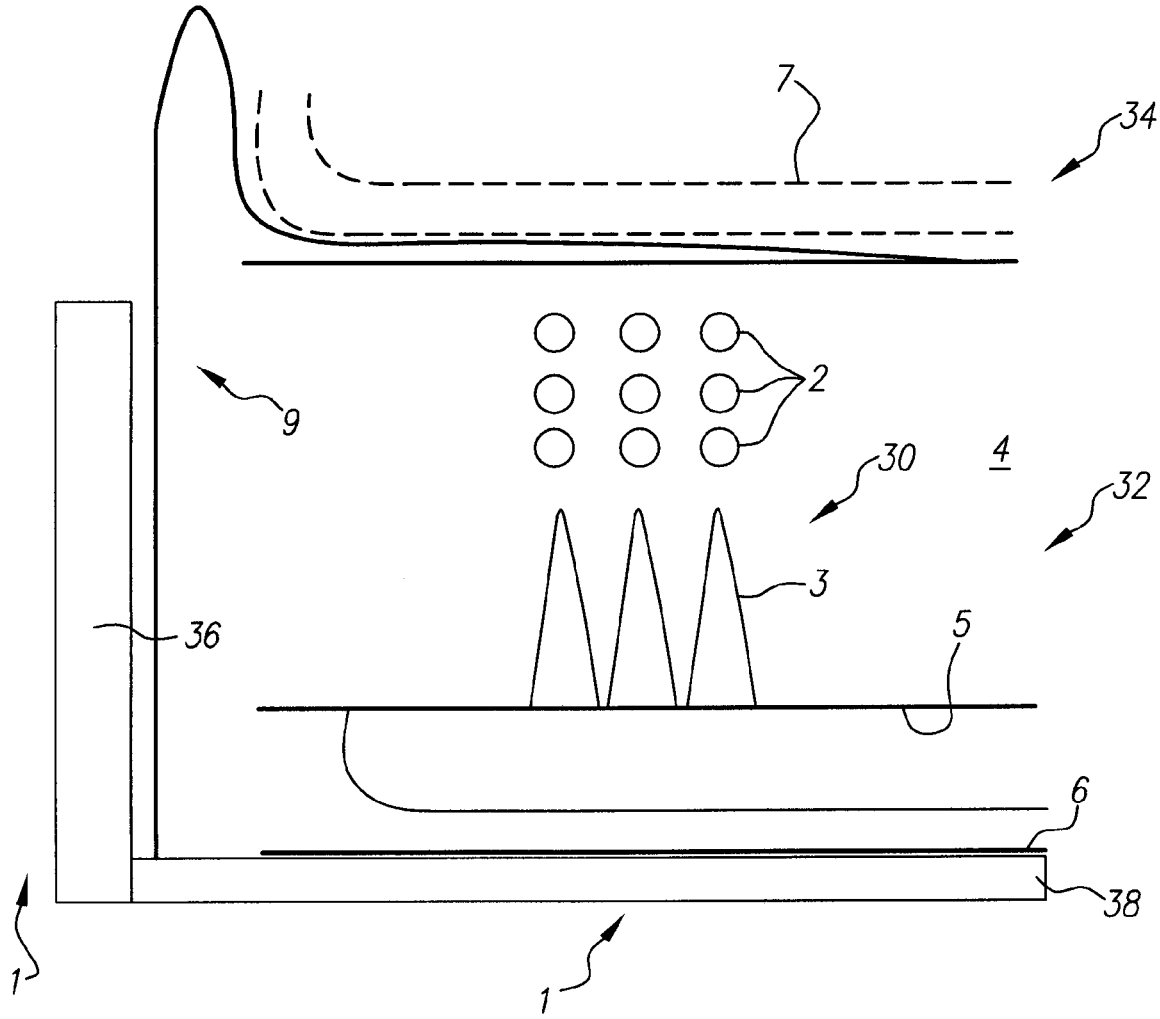
FIG. 2 (Prior Art)
FIG. 2 is a partial schematic view of a prior art printhead assembly.
Figure 3:
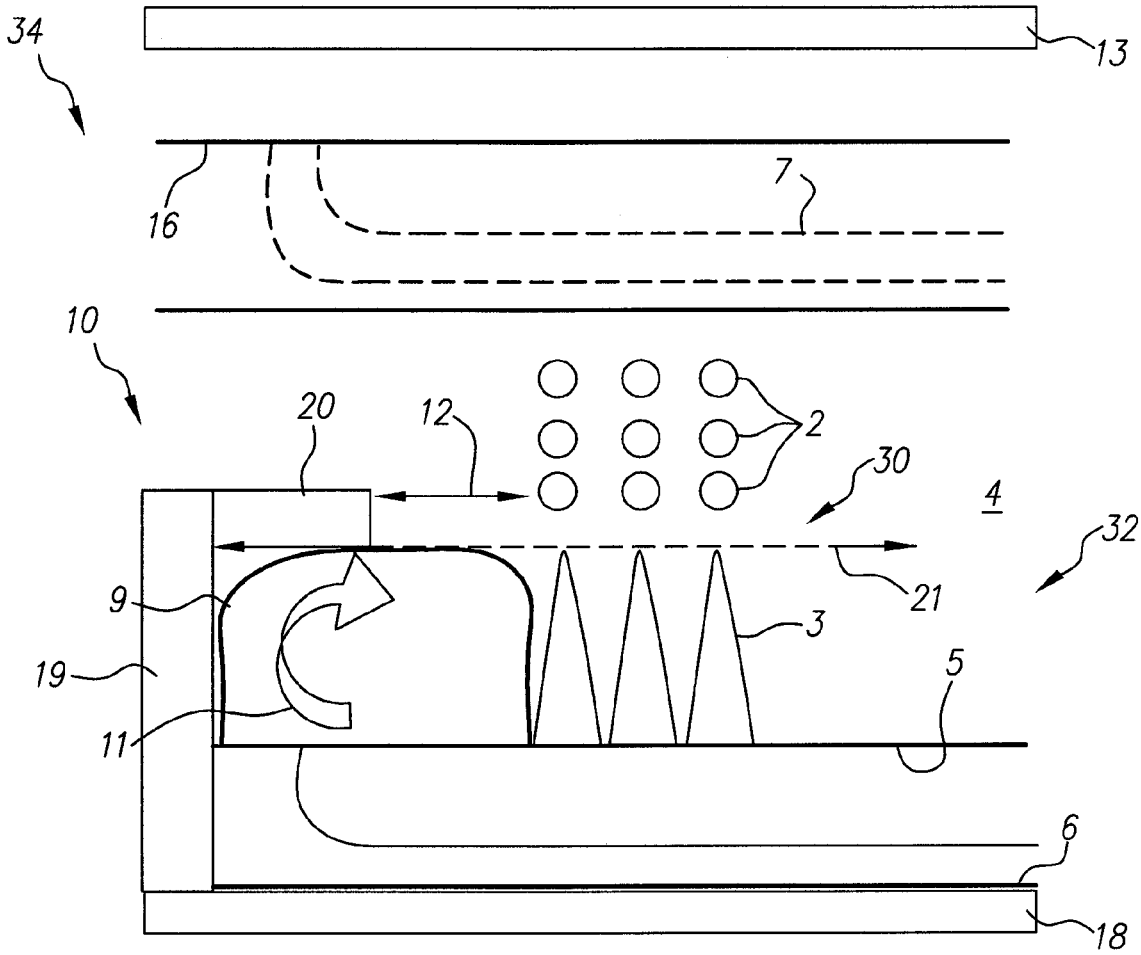
FIG. 3 is a partial schematic view of a printhead assembly including a first example embodiment of the present invention.

Referring to FIG. 3, a drop generator 13 is operable to create liquid drops 2 in a known manner. Some of the liquid drops 2 are deflected in a known manner toward a contact region 30 of a catcher face 4. After the liquid drops 2 contact the contact region of the catcher face 4, the liquid drops 2 form a liquid film 3 that travels toward an opening or throat 5 from which the liquid is removed from the printhead assembly 34 and either recycled or disposed. A charge plate 16 including charge electrodes 7 and associated circuitry is located between the drop generator 13 and the catcher 32.

During a start up or shut down sequence, a lip portion 18 of an eyelid 15 (shown in FIG. 5) is operatively associated with the catcher 32 to form a seal with the catcher below the catch pan 6 in order to prevent liquid from contacting a recording media. After the start up sequence is complete, the lip portion 18 of eyelid 15 is positioned away from the catcher to enable liquid drops to pass between the eyelid 15 and the catcher 32 and contact the recording media.

A pair of walls 10 (only one of which is shown in FIG. 3, the second wall being essentially a mirror image of the first wall) is positioned on either side of the liquid removal opening 5 of the catcher 32. A first portion 19 of the each of the pair of walls extends in a first direction toward the fluid drop generator 13. The first portion 19 of each of the pair of walls can be substantially perpendicular to the length of the opening 5 of the catcher 32. A second portion 20 of each of the pair of walls extends in a second direction at least partially toward each other along the length of the catcher 32. The pair of walls 10 and the lip portion 18 are operable to form a fluid seal at least partially around the opening of the catcher to help prevent liquid from wicking up the catcher face. Lip portion 18 can extend beyond the pair of walls 10 (represented by reference sign 24 in FIG. 4).

Figure 4:
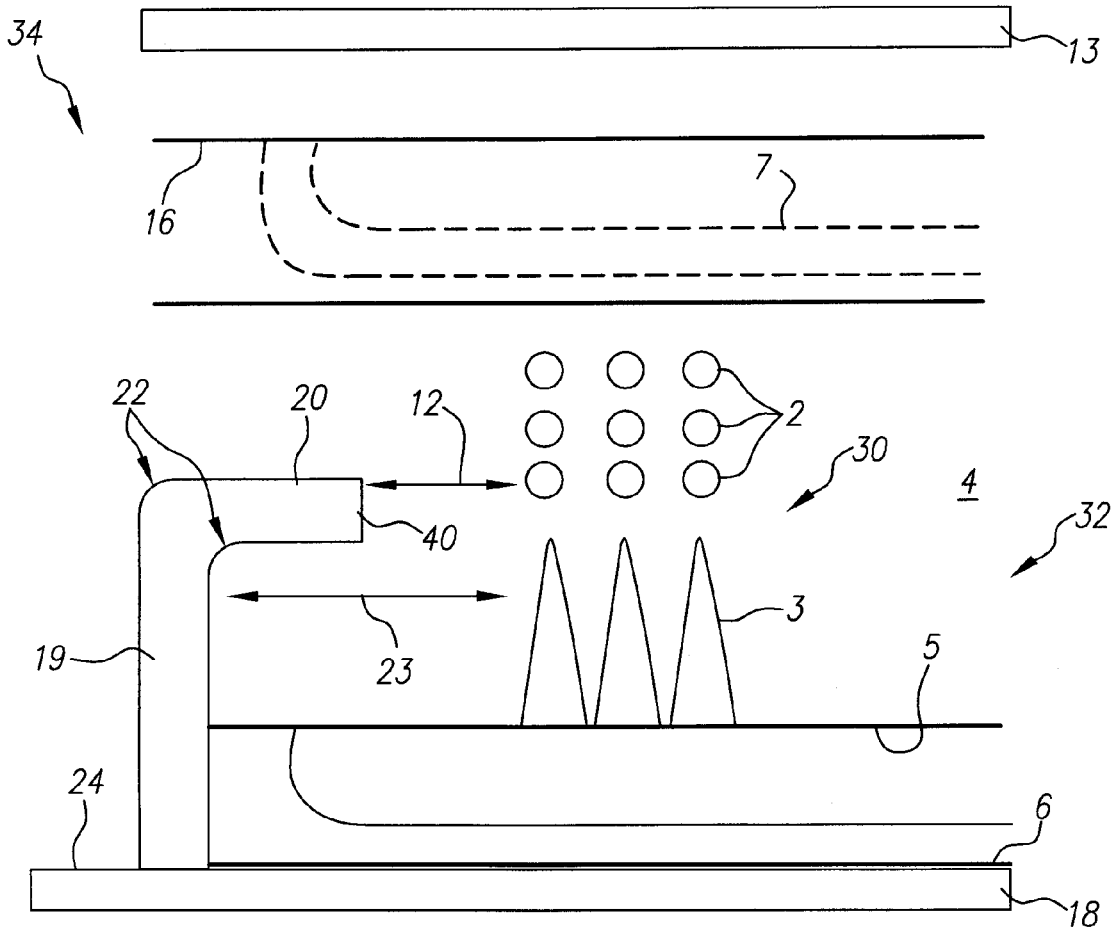
FIG. 4 is a partial schematic view of a printhead assembly including a second example embodiment of the present invention.

The first portion 19 and the second portion 20 of the pair of walls 10 can intersect form a corner that has an angle. For example, the second portion 20 of the wall can be positioned perpendicular relative to the first portion 19 of the wall. Alternatively, the second portion 20 of the wall can be positioned at a non-perpendicular angle relative to the first portion 19 of the wall. The angle can include a radius fillet 22 as shown in FIG. 4.

Example configurations of the pair of walls 10 will be discussed next. The first portion 19 of each of the pair of walls 10 can extend to at least the liquid drop contact region 30 of the catcher 32 (represented by line 21 shown in FIG. 3) from the area of the catcher 32 that is contacted by the lip portion 18. Alternatively or additionally, the first portion 19 of the pair of walls 10 can be spaced apart from the liquid drop contact region 30 of the catcher by a distance X (represented by line 23 in FIG. 4). When this is done, the second portion 20 of the pair of walls 10 can include an end 40 spaced apart from the liquid drop contact region 30 of the catcher 32 by a distance Y (represented by line 12 in FIG. 4), where $Y \leqq 0.5X$. Alternatively, the second portion 20 of the pair of walls 10 can include an end 40 spaced apart from the liquid drop contact region 30 of the catcher 32 by a distance Y, where $0 \leqq Y \leqq 0.8$ mm.

It has been found that when one or more of these example configurations are used, accumulated liquid 9 may still wick up the first portion 19 of wall 10. However, when the liquid 9 contacts the second portion 20 of wall 10, the liquid begins circulating in a circular motion 11 which eventually causes the liquid 9 to move back toward liquid removal opening 5.

Figure 5:
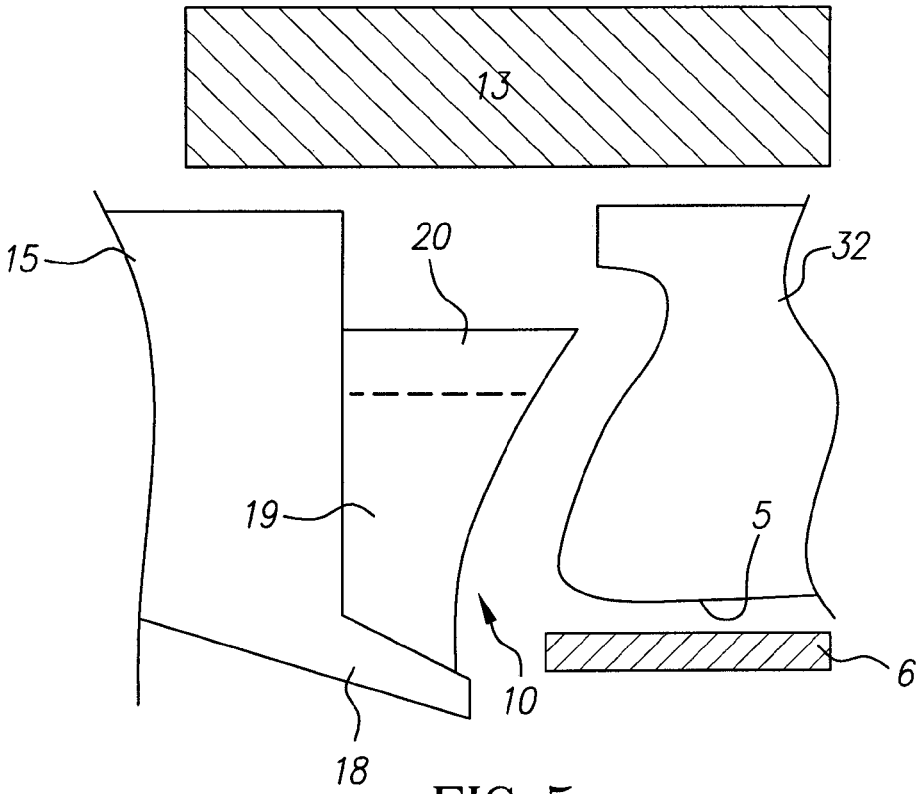
FIG. 5 is a partial schematic side view of a printhead assembly including a third example embodiment of the present invention.
Figure 6:
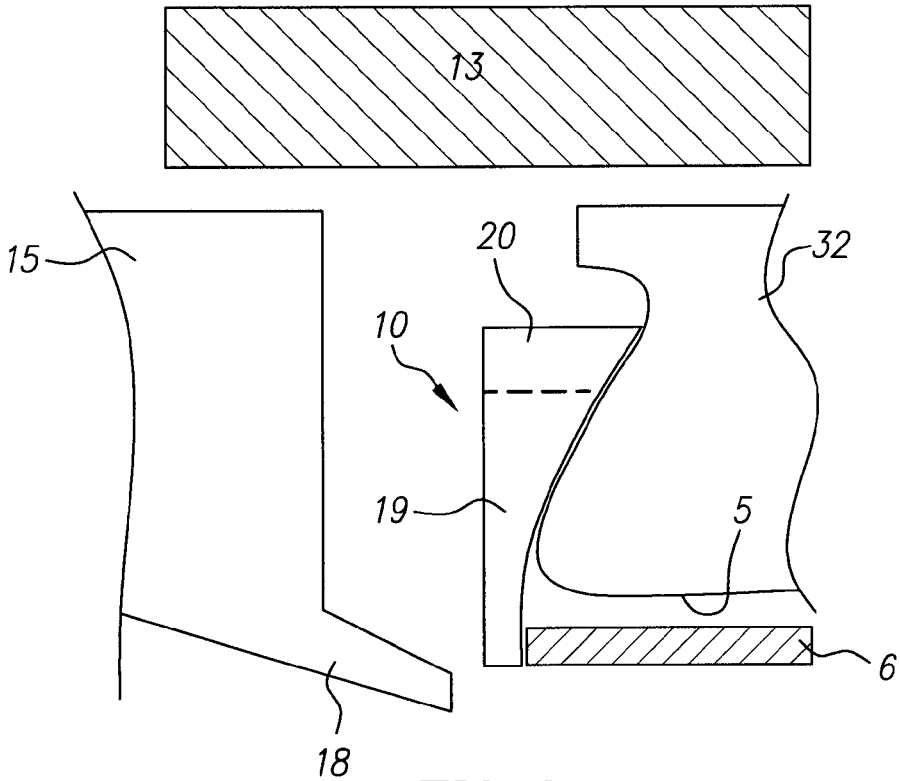
FIG. 6 is a partial schematic side view of a printhead assembly including a fourth example embodiment of the present invention.

The pair of walls 10 can be located on either the eyelid 15 as shown in FIG. 5 or the catcher 32 as shown in FIG. 6. Depending on its location, the portion 19 or 20 of each wall 10 that is contactable with either the eyelid 15 or the catcher 32 can be contoured to substantially mirror the shape of either the eyelid 15 or the catcher 32, as is shown in FIGS. 5 and 6. The pair of walls 10 can be integrally formed on either of the catcher 32 or the eyelid 15. Alternatively, the pair of walls 10 can be attached to either the catcher 32 or the eyelid 15 using any known technique. For example, the pair of walls 10 can be glued or fastened to either the catcher 32 or the eyelid 15.

At least a portion 19 or 20 of each of the pair of walls 10 can be made from a polymeric material to improve the seal between the pair of walls 10 and either the catcher 32 or the eyelid 15 depending on the location of the pair of walls 10. At least a portion 19 or 20 of each of the pair of walls 10 can be made from a hydrophobic material to help guide the liquid 9 back toward the liquid removal opening 5 of the catcher 32.

The invention has been described in detail with particular reference to certain preferred embodiments thereof, but it will be understood that variations and modifications can be effected within the scope of the invention.

The invention claimed is:

1. A printing system comprising:

a catcher, portions of the catcher defining a fluid drop contact region, the catcher including a catch pan and an opening for passage of fluid away from the fluid contact region, the opening having two ends;

a fluid drop generator operable to form fluid drops, at least some of which contact the fluid drop contact region of the catcher;

an eyelid operatively associated with the catcher, the eyelid including a lip portion that forms a seal with the catcher below the catch pan of the catcher when the eyelid is associated with the catcher; and a pair of walls positionable at locations outside of the ends of the opening such that the pair of walls and the eyelid are operable to form a fluid seal at least partially around the opening of the catcher, a first portion of the each of the pair of walls extending in a first direction toward the fluid drop generator, and a second portion of each of the pair of walls extending in a second direction at least partially toward each other.

2. The printing system of claim 1, wherein the pair of walls is located on the eyelid.

3. The printing system of claim 1, wherein the pair of walls is located on the catcher.

4. The printing system of claim 1, wherein the first portion of each of the pair of walls extends to at least the fluid drop contact region of the catcher.

5. The printing system of claim 1, the first portion of the wall being spaced apart from the fluid drop contact region of the catcher by a distance X, the second portion of the wall including an end spaced apart from the fluid drop contact region of the catcher by a distance Y, wherein $Y \leqq 0.5X$.

6. The printing system of claim 1, the second portion of the wall including an end spaced apart from the fluid drop contact region of the catcher by a distance Y, wherein $0 \leqq Y \leqq 0.8$ mm.

7. The printing system of claim 1, wherein at least a portion of each of the pair of walls is made from a polymeric material.

8. The printing system of claim 1, wherein at least a portion of each of the pair of walls is made from a hydrophobic material.

9. The printing system of claim 1, wherein the pair of walls are positioned on the eyelid and include a portion that is contactable with the catcher and contoured to substantially mirror the shape of the catcher.

10. The printing system of claim 1, wherein the pair of walls are positioned on the catcher and include a portion that is contactable with the eyelid and is contoured to substantially mirror the shape of the eyelid.

11. The printing system of claim 1, wherein the lip portion of the eyelid extends beyond the pair of walls.

12. A printing system comprising:

a catcher having a length, portions of the catcher defining a fluid drop contact region, the catcher including an opening for passage of the fluid away from the fluid contact region, the opening having two ends;

a fluid drop generator operable to form fluid drops, at least some of which contact the fluid drop contact region of the catcher;

an eyelid operatively associated with the catcher; and a pair of walls positionable at locations outside of the ends of the opening such that the pair of walls and the eyelid are operable to form a fluid seal at least partially around the opening of the catcher, a first portion of the each of the pair of walls extending in a first direction toward the fluid drop generator, and a second portion of each of the pair of walls extending in a second direction at least partially toward each other, the first portion of the wall being spaced apart from the fluid drop contact region of the catcher by a distance X, the second portion of the wall including an end spaced apart from the fluid drop contact region of the catcher by a distance Y, wherein $Y \leqq 0.5X$.

13. A printing system comprising:

a catcher having a length, portions of the catcher defining a fluid drop contact region, the catcher including an opening for passage of the fluid away from the fluid contact region, the opening having two ends;

a fluid drop generator operable to form fluid drops, at least some of which contact the fluid drop contact region of the catcher;

an eyelid operatively associated with the catcher; and a pair of walls positionable at locations outside of the ends of the opening such that the pair of walls and the eyelid are operable to form a fluid seal at least partially around the opening of the catcher, a first portion of the each of the pair of walls extending in a first direction toward the fluid drop generator, and a second portion of each of the pair of walls extending in a second direction at least partially toward each other, the second portion of the wall including an end spaced apart from the fluid drop contact region of the catcher by a distance Y, wherein $0 \leqq Y \leqq 0.8$ mm.

* * * * *